US006193180B1

(12) United States Patent
Haikkala et al.

(10) Patent No.: US 6,193,180 B1
(45) Date of Patent: Feb. 27, 2001

(54) ARRANGEMENT IN A PULP GRINDER

(75) Inventors: Pekka Haikkala, Siivikkala; Jouko Hautala, Tampere; Heikki Liimatainen, Tampere; Kari Pärssinen, Tampere; Simo Setälä, Tampere; Olli Tuovinen, Tampere, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/319,313

(22) PCT Filed: Dec. 12, 1997

(86) PCT No.: PCT/FI97/00783

§ 371 Date: Jul. 12, 1999

§ 102(e) Date: Jul. 12, 1999

(87) PCT Pub. No.: WO98/27268

PCT Pub. Date: Jun. 25, 1998

(30) Foreign Application Priority Data

Dec. 16, 1996 (FI) ..... 965048

(51) Int. Cl.[7] ..... B02C 19/12

(52) U.S. Cl. ..... 241/282

(58) Field of Search ..... 241/280–282

(56) References Cited

U.S. PATENT DOCUMENTS 1,626,015 * 4/1927 Ullgren ..... 241/282

FOREIGN PATENT DOCUMENTS

| | | |
|---|---|---|
| 28 12 299 | 9/1979 | (DE) . |
| 11486 | 12/1925 | (FI) . |
| 43805 | 3/1971 | (FI) . |
| 341 865 | 1/1972 | (SE) . |

* cited by examiner

*Primary Examiner*—Mark Rosenbaum
(74) *Attorney, Agent, or Firm*—Alston & Bird LLP

(57) ABSTRACT

An arrangement in a pulp grinder comprising a grindstone (1), a feed chute (2), and a piston to feed wood (3) against the grindstone (1). The arrangement comprises separate pushing members (6), which are arranged to push the wood (3) against the grindstone (1) at essentially the entire width of the feed chute when the percussion piston is moved back to the stroke position to allow the feed of a new batch of wood.

7 Claims, 4 Drawing Sheets

ARRANGEMENT IN A PULP GRINDER

Figure 1A:
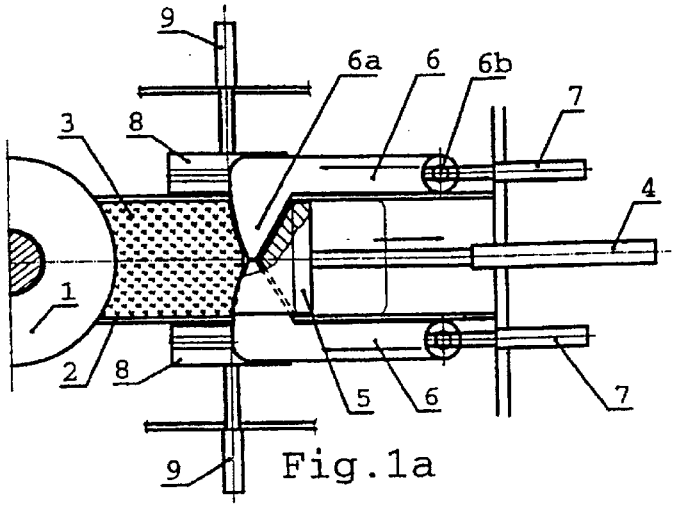
Figure 1B:
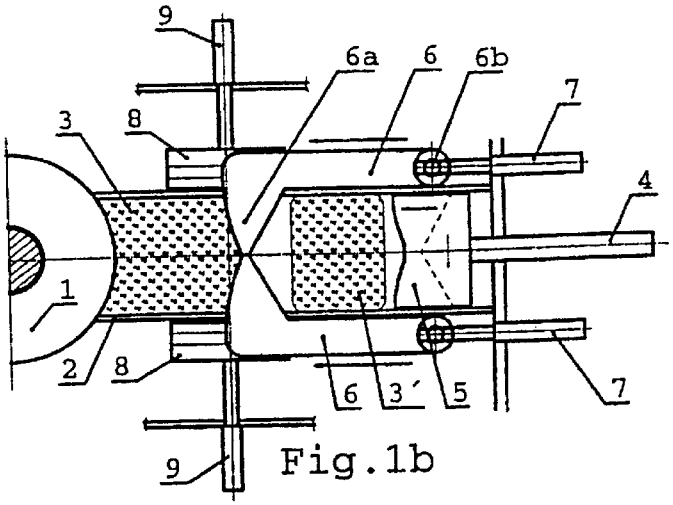
Figure 1C:
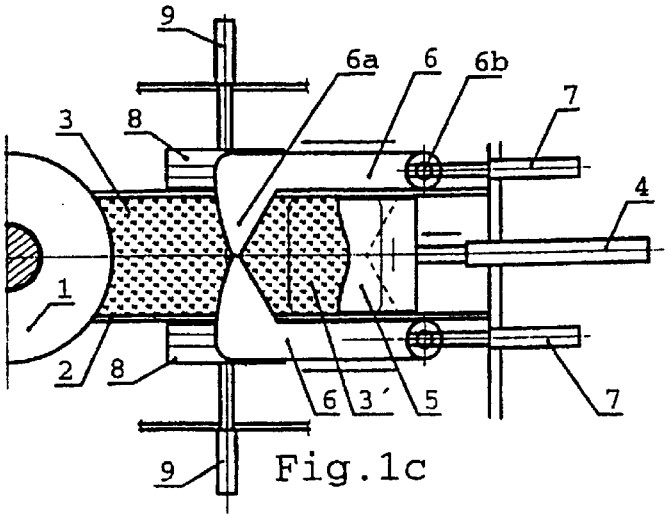
Figure 1D:
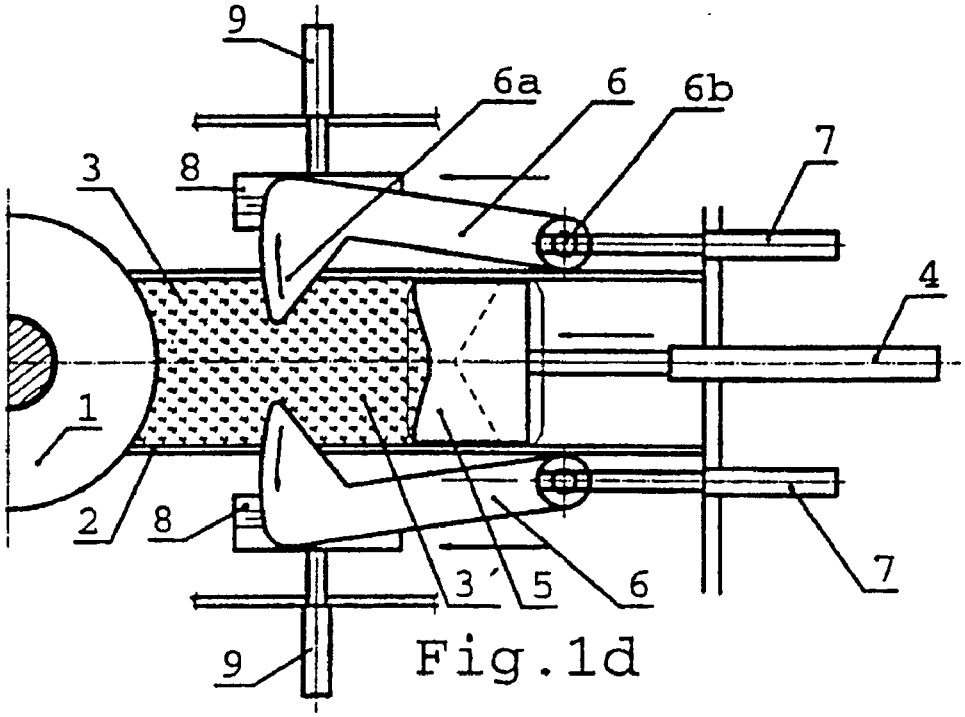
Figure 1E:
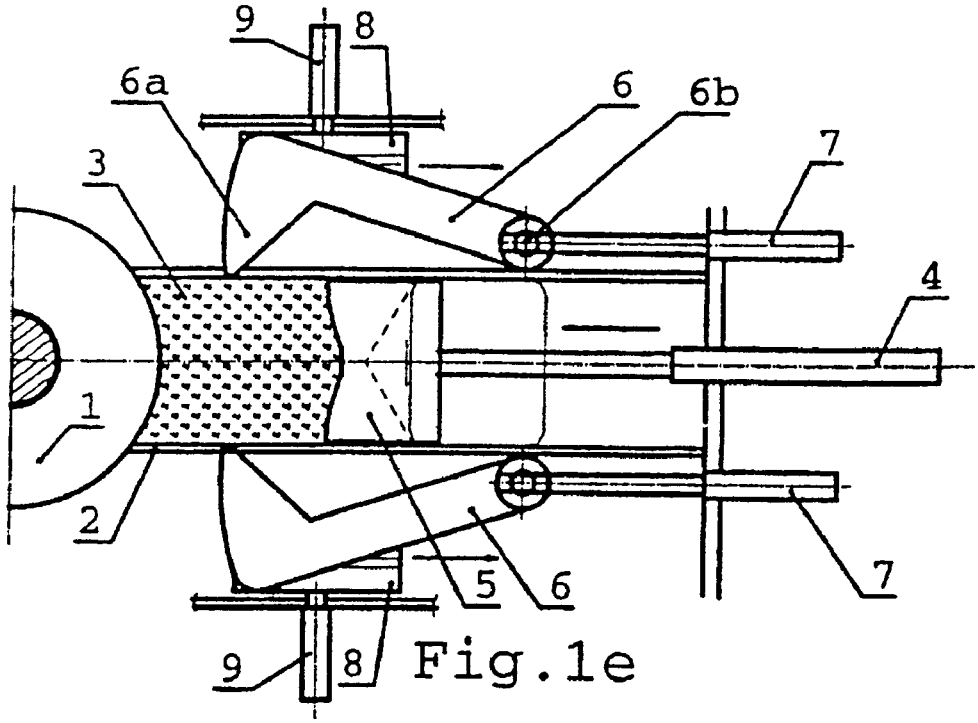

The invention relates to an arrangement in a pulp grinder comprising a grindstone, a feed chute extending to the grindstone, and a piston to feed the wood to be ground in the feed chute against the grindstone, the wood being fed into a grinding space essentially in the axial direction of the grindstone.

When wood is ground to produce fibres, the grinders typically used are grinders in which the blocks of wood are pressed against the surface of a rotary grindstone, simultaneously spraying water there to produce a pulp suspension. The most generally, the wood supply is implemented in pulp grinders on a discontinuous basis: one batch of wood at a time is fed into a feed chute, after which the wood in the feed chute is pressed by a cylinder and a piston against the grindstone. In order that the output would be as great as possible, two feed chutes, with cylinders, are usually arranged on the opposite sides of the grindstone. Consequently, when a feed chute is being filled, the grindstone is subjected to less load than when both the feed chutes are in the grinding step, and this causes both uneven loading and variation in the quality of the ground pulp. Further, the drawback of the discontinuous supply is that the output is smaller when the wood is fed in batches than when continuous grinding is used. Another problem in the discontinuous grinding is that the blocks of wood fed during the compression press more firmly against each other, which also results in variation between the production rates at the beginning and at the end of the grinding. Consequently, for example the freeness of the ground pulp is higher at the beginning of the compression, dropping toward the end of the furnace, even if the feed rate at the piston of the cylinder is adjusted to remain constant. For the same reason, the motor is loaded unevenly.

Previously known are also continuous grinders in which the continuous wood supply is based on moving feed chains on both sides of a feed chute and on the weight of the wood in the feed chute. Such a grinder is known, for example, from German Offenlegungsschrift 2,8 12,299. The drawback of the solution is that to provide the continuous wood supply and sufficient compression, the chains must be rather long, which in practice means that the feed chute must be up to 6–8 meters high. The contact surface between the chains and the blocks of wood that are being fed is thus sufficiently large, and the weight of the pile of wood simultaneously helps to press the wood against the feed chains for compression. Because of this, only an essentially upright feed chute can be used in the grinding process, which notably restricts the amount of wood that can be ground simultaneously. As a result, the capacity of the grinder is naturally smaller than in solutions where wood fed from two or more feed chutes can be ground simultaneously. Another problem in the high feed chute is that the blocks of wood may settle obliquely, which affects the grindstone and because of which the grinder must be sharpened unduly often in order to correct the obliqueness. Since the pressing force of the chains does not divide evenly between the blocks of wood in the feed chute, but in practice the blocks of wood that are the closest to the chains are fed at a higher feed rate than those in the middle of the feed chute, this affects the quality and may also cause the above obliqueness.

The object of the present invention is to provide an arrangement in a grinder in which wood can be fed continuously in an essentially unchanged manner against the grindstone, maintaining the grinding conditions essentially unchanged, and feeding the wood into the grinder in batches.

The arrangement of the invention is characterized in that the arrangement comprises pushing members on two opposite sides of the feed chute, the pushing members being insertable at the end of the piston's travel distance into recesses in the piston crosswise of the feed chute behind the wood to be ground and being able to push the wood to be ground toward the grindstone when the piston is moved to the beginning of its travel distance so as to allow the feed of a new batch of wood.

The essential idea of the invention is that it comprises separate pushing members which at the end of the piston stroke push through the apertures formed in the piston to press the batch of wood toward the grindstone at essentially the entire width of the feed chute in the crosswise direction so that the piston can move to the starting position of its stroke to allow the feed of a new batch of wood, and that when the piston pushes the new batch of wood toward the grindstone, the pushing members move aside so as to allow the new batch of wood to press the wood already in the feed chute.

Figure 2:
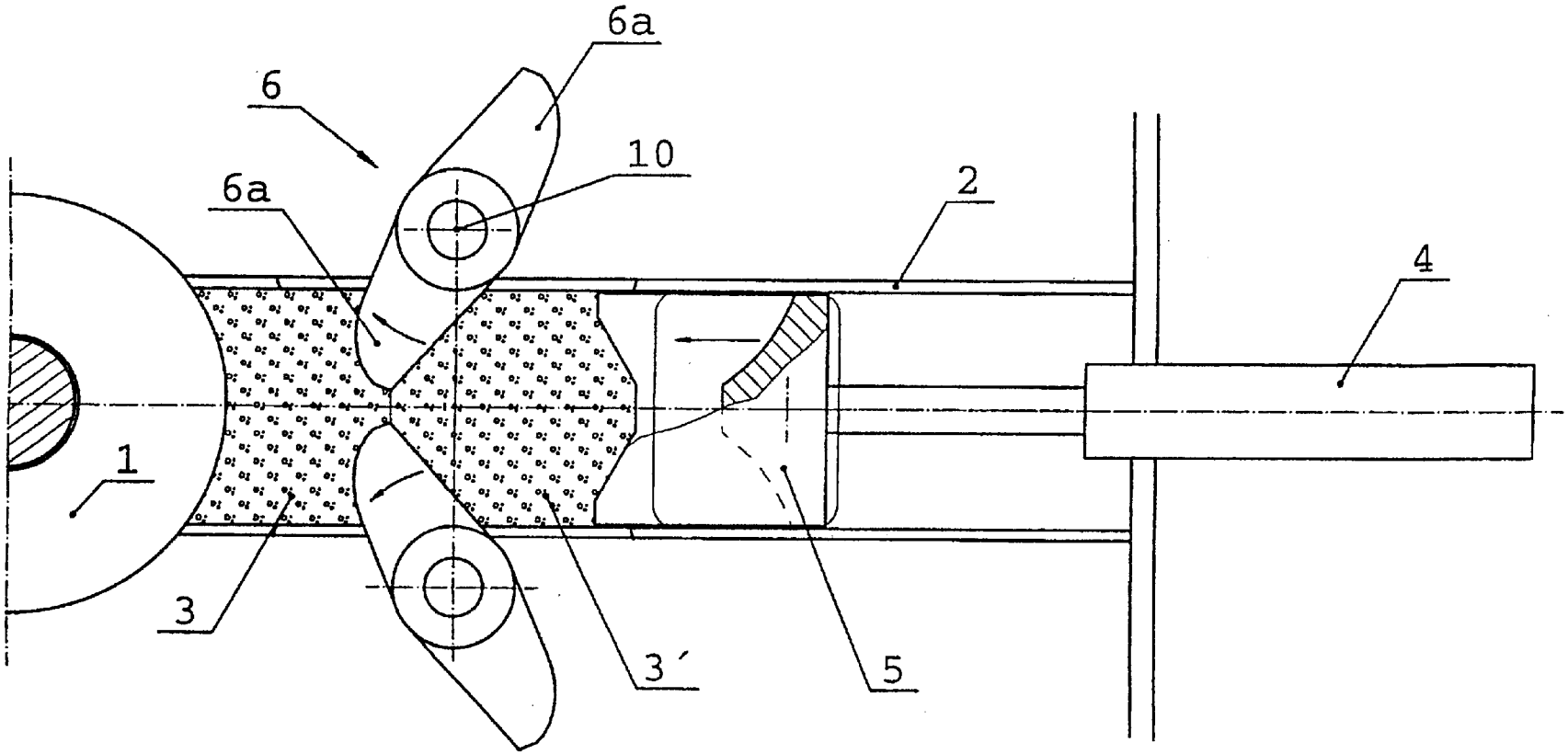
Figure 3:
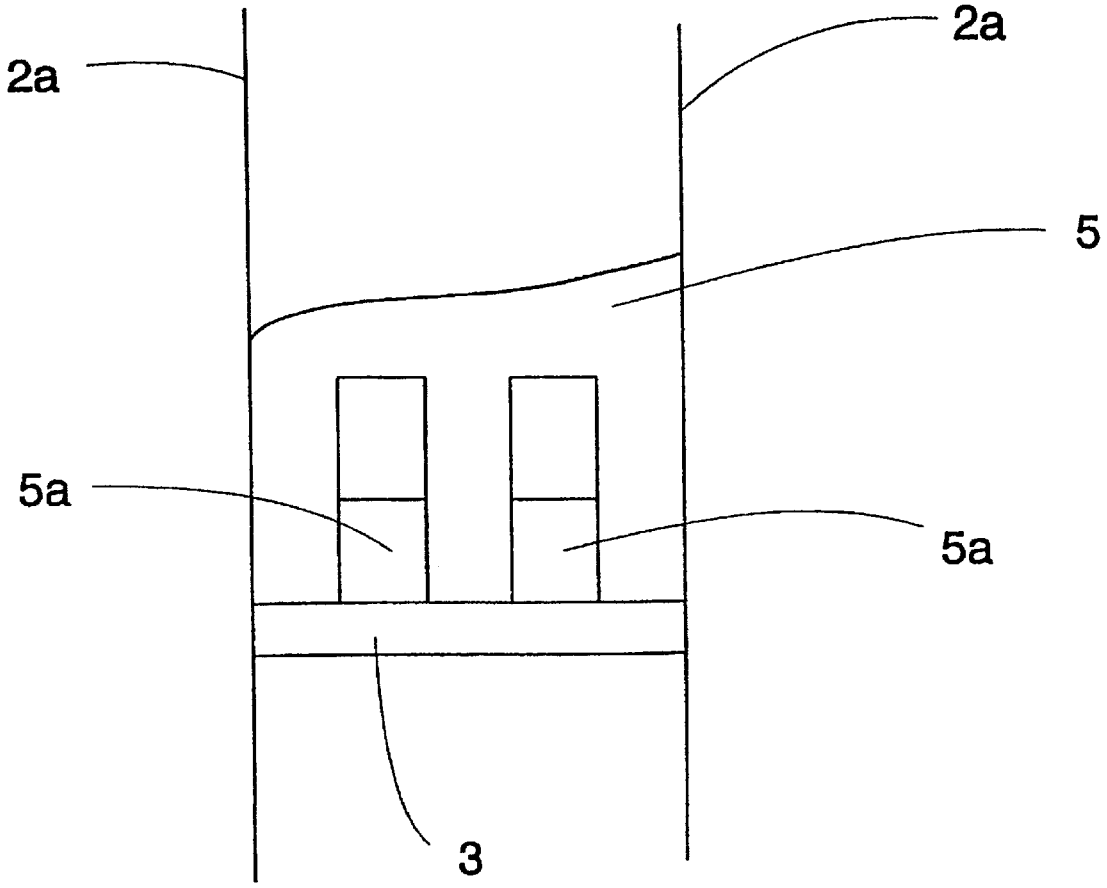

The invention will be described in greater detail with reference to the attached drawings, in which FIGS. 1*a* to 1*e* illustrate an embodiment of the arrangement according to the invention shown as a sectional side view of the feed chute, FIG. 2 is a schematic view of another embodiment of the arrangement according to the invention shown as a sectional side view of the feed chute, and FIG. 3 is a schematic top view of a piston suitable for use in the embodiments of the invention illustrated in FIGS. 1 and 2.

FIGS. 1*a* to 1*e* show a partial view of a grinder comprising a grindstone 1 that rotates about its axle. Further, the grinder comprises a feed chute 2 in which there is wood 3 that is pushed by a piston, connected to a feed cylinder 4, toward the grindstone 1. The figures also show pushing members 6. The pushing members 6 move lengthwise of the feed chute 2 and comprise pushing heads 6*a* extending to the feed chute 2 so that when the pushing heads 6*a* are in the feed chute 2, they together extend at essentially the entire width of the feed chute 2. The pushing members 6 are connected with articulations 6*b* to pushing cylinders 7, by which the pushing members 6 can be moved lengthwise of the feed chute 2. In this embodiment the pushing members 6 are arranged to be guided by guide rails 8, and the guide rails 8, in turn can be moved by guide cylinders 9 either toward the feed chute 2 or away from it, depending on the situation. As shown by the sectional view of FIG. 1*a*, the piston 5 comprises a recess into which the pushing head 6*a* can push behind the wood 3 when the piston 5 presses the wood 3 toward the grindstone 1 upon ending the stroke.

The arrangement according to the invention operates so that when wood is ground, the piston 5 pushes the wood 3 in the feed chute 2 toward the grindstone 1, until the piston 5 reaches the position shown in FIG. 1*a*. The pushing members 6 are here at their extreme position, the furthest away from the grindstone 1, and they can be pushed by the guide cylinders 9 and the guide rails 8 into the recesses in the piston 5 inside the feed chute 2. The wood 3 is then pushed further toward the grindstone 1 by the pushing cylinders 7 that act on the pushing heads 6*a* of the pushing members 6, whereby the guide rails 8 guide the pushing members so that the pushing heads 6*a* stay inside the feed chute 2, compressing the wood 3. The piston 5 is simultaneously pulled by the feed cylinder 4 to the rearmost position of its travel distance, shown in FIG. 1*b*, and a new batch of wood 3' is fed in front of the piston 5 on the side of the grindstone 1 by pushing the wood into the feed chute 2 in the axial direction of the grindstone 1. This can be effected in a manner known per se, for example according to the embodiments described in Finnish Patent 69,653 or some other previously known embodiments. After this, the piston 5 is moved by the feed cylinder 4 toward the grindstone, whereby it presses the new batch of wood 3' against that surface of the pushing heads 6*a* of the pushing members 6 which is on the side of the piston. The batch of wood '3 is thus compressed simultaneously as the pushing members and the pushing heads press the wood 3 that has been supplied earlier toward the grindstone.

When the new batch of wood 3' has been compressed sufficiently tightly, the pushing heads 6*a* of the pushing members 6 are slowly pulled outward of the feed chute 2 so that the new batch of wood 3' is pressed by the piston 5 against the wood 3 that has been supplied earlier, and the feed of the wood will continue in this way continuously and evenly, while the compression remains essentially unchanged. When the pushing heads 6*a* of the pushing members 6 have been pulled out of the feed chute, the pushing members 6 are moved back to their initial position by the pushing cylinders 7, while the piston 5 continues to press the wood 3 against the grindstone 1. When the pushing members 6 are again in their extreme position the furthest away from the grindstone 1, and when the piston 5 approaches the end of its stroke, the pushing heads 6*a* are again pushed into the recesses of the piston 5 in the feed chute by the guide rails 8 and the guide cylinders 9 in the manner shown in FIG. 1*a*, and the cycle of operation will be repeated.

The advantage of the arrangement is that wood can be supplied to the grinder in batches, which is the simplest and the most reliable feeding method up to a point. Simultaneously, the compression that the wood is subjected to and thereby the conditions between the wood and the grinding surface of the grindstone are maintained essentially constant, since separate pushing members are used. Consequently, the supply of wood against the grindstone is thus essentially continuous and happens essentially evenly, whereby an essentially even continuous grinding process is provided, in which the characteristics of the ground pulp vary essentially less than before, and the loading of the motor of the grinder can be maintained essentially constant and advantageous in respect of the grinding.

FIG. 2 illustrates another embodiment of the arrangement according to the invention, showing a sectional side view of the feed chute. In the embodiment of FIG. 2, each pushing member 6 consists of two pushing heads 6*a*, which join to form a member rotating about an axle 10. Pushing members like this are arranged on both sides of the feed chute 2, and when they are essentially crosswise of the feed chute 2, they extend at essentially the entire width of the feed chute in the crosswise direction. Even in this embodiment the piston comprises recesses corresponding with the pushing members 6 so that the pushing heads 6*a* of the pushing members 6 can turn inside the piston 5 when the piston is essentially in the pressing position. In this embodiment, the pushing members rotate, and as they rotate they press the wood 3 in the feed chute 2 toward the grindstone 1 while the piston 5 moves away from the grindstone so as to allow the feed of a new batch of wood. Correspondingly, when the new batch of wood 3' is compressed in front of the piston 5 toward the grindstone, the pushing heads 6*a* turn outward of the feed chute, thereby allowing the new batch of wood 3' to press against the wood 3 that has been supplied to the feed chute earlier, so that in the end all the wood is pressed only by the piston 5. To simplify the operation, the pushing members 6 turn about the axles 10 in two phases so that the pushing members 6 turn one full round per two piston strokes. The surfaces of the pushing members 6 are such that when the pushing members are in the feed chute 2, their surface toward the grindstone 1 is curved, whereby they can be moved more easily along the wood to be pressed outward of the feed chute.

FIG. 3 shows, by way of example, a top view of a piston 5 suitable for use in the implementation of the solution according to FIGS. 1*a* to 1*e* and FIG. 2. FIG. 3 shows that the piston 5 comprises two recesses 5*a*, in which the pushing members 6 can settle when the piston 5 is pressed against the wood 3. There may be one or more such recesses 5*a*, depending on how many and what kind of pushing members are used above and below the feed chute 2.

The essential feature is that the compression effected by the pushing members is symmetrical so that the wood stays compressed against the grindstone 1 at the entire width of the feed chute 2, whereby the feeding and grinding processes are even.

The above description and the drawings present the invention only by way of example, without limiting it in any way. The essential feature of the invention is that in addition to the pressing piston it comprises separate pushing members, by which the wood can be pushed further against the grindstone when the percussion piston ends the stroke and moves back to the initial position so as to allow the feed of a new batch of wood. Another essential feature is that at some point of the stroke of the percussion piston the pushing members 6 are pulled essentially entirely out of the feed chute so that the percussion piston can compress the wood in the feed chute tightly before the feed of a new batch of wood. In the embodiments of FIGS. 1*a* to 1*e* and of FIG. 2, the pushing members 6 are preferably symmetrically on the opposite sides of the feed chute 2. Further, they can comprise one pushing head or the like on both sides in the middle of the feed chute, or two or more pushing heads and potentially also pushing members on one and the same side of the feed chute. Correspondingly, the piston 5 then comprises a corresponding number of recesses, so that each pushing head can push into the piston behind the wood. In the embodiment illustrated by the figures, the pushing members 6 are arranged on those sides of the feed chute 2 which are parallel to the axle of the grindstone 1. Since the wood 3 in the feed chute is also parallel to the axle of the grindstone 1, the pushing members can be pushed behind the wood crosswise thereof. Also, the surfaces of the piston 5 that come into contact with the wood are also crosswise of the wood, which enables the implementation of the process in accordance with the invention. The invention is not restricted to a pulp grinder of a certain type. It can thus be used in both non-pressure grinders and pressure grinders, the other necessary operations and apparatuses being implemented conventionally in a previously known manner so that they are suited to the solutions in question.

What is claimed is:

1. An apparatus for grinding wood in a pulp grinder, the apparatus comprising:

a grindstone;

a feed chute extending to the grindstone for feeding wood therein to the grindstone along a feed direction, the feed chute defining a width crosswise to the feed direction;

a piston movable within the feed chute along the feed direction for pressing wood in the feed chute against the grindstone, the piston being retractable away from the grindstone to allow a new batch of wood to be fed into the feed chute ahead of an end of the piston that presses against the wood, the end of the piston defining recesses therein; and pushing members disposed on two opposite sides of the feed chute, the pushing members being insertable into the recesses in the end of the piston when the piston reaches an end of its travel in the feed direction such that the pushing members move behind the wood in the feed chute, the pushing members being structured and arranged to push the wood in the feed direction toward the grindstone as the piston is retracted to allow a new batch of wood to be fed into the feed chute.

2. The apparatus of claim 1, wherein the pushing members comprise pushing heads that together extend across substantially the entire width of the feed chute.

3. The apparatus of claim 1, wherein the pushing members comprise pushing heads connected to pushing cylinders operable to move the pushing heads lengthwise of the feed chute, the pushing heads further being movable crosswise of the feed chute for moving into the feed chute behind the wood and for moving back out of the feed chute after a new batch of wood is fed into the feed chute and the piston begins pressing the new batch toward the grindstone.

4. The apparatus of claim 3, further comprising guide rails on the two opposite sides of the feed chute, the guide rails being movable crosswise of the feed chute toward and away therefrom by guide cylinders connected to the guide rails, and the pushing heads being connected to the guide rails for movement therewith in the crosswise direction.

5. The apparatus of claim 1, wherein the pushing members comprise pushing heads rotatable about axles so that rotation of the pushing heads causes the pushing heads to move into the recesses in the piston and into the feed chute behind the wood, and further rotation of the pushing heads causes the pushing heads to press the wood toward the grindstone.

6. The apparatus of claim 1, wherein the pushing members comprise pushing heads, and the pushing members are movable such that in at least one position of the pushing members the pushing heads are essentially entirely outside the feed chute.

7. The apparatus of claim 1, wherein the pushing members are arranged on sides of the feed chute that extend parallel to an axle of the grindstone.

* * * * *